US006867976B2

(12) United States Patent
Belady et al.

(10) Patent No.: US 6,867,976 B2
(45) Date of Patent: Mar. 15, 2005

(54) PIN RETENTION FOR THERMAL TRANSFER INTERFACES, AND ASSOCIATED METHODS

(75) Inventors: Christian L. Belady, McKinney, TX (US); Eric C. Peterson, McKinney, TX (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/690,450

(22) Filed: Oct. 21, 2003

(65) Prior Publication Data

US 2004/0188062 A1 Sep. 30, 2004

Related U.S. Application Data

(60) Continuation-in-part of application No. 10/676,982, filed on Oct. 1, 2003, which is a division of application No. 10/074,642, filed on Feb. 12, 2002.

(51) Int. Cl.[7] ..... H05K 7/20

(52) U.S. Cl. ..... 361/704; 361/707; 361/717; 165/80.3; 165/185; 257/718; 257/727

(58) Field of Search ..... 361/690, 698, 361/699, 704, 707, 717; 257/718, 727; 174/16.1, 16.3; 165/80.3, 185

(56) References Cited

U.S. PATENT DOCUMENTS

| | | | | | |
|---|---|---|---|---|---|
| 4,381,032 | A | * | 4/1983 | Cutchaw | 165/46 |
| 4,639,829 | A | * | 1/1987 | Ostergren et al. | 361/718 |
| 4,928,207 | A | * | 5/1990 | Chrysler et al. | 361/700 |
| 5,097,385 | A | * | 3/1992 | Chao-Fan Chu et al. | 361/703 |
| 5,247,425 | A | * | 9/1993 | Takahasi | 361/717 |
| 5,294,830 | A | * | 3/1994 | Young et al. | 257/714 |
| 5,390,076 | A | * | 2/1995 | Umezawa | 361/689 |
| 5,394,299 | A | | 2/1995 | Chu et al. | |
| 5,463,528 | A | * | 10/1995 | Umezawa | 361/699 |
| 6,223,815 | B1 | * | 5/2001 | Shibasaki | 165/185 |
| 6,404,638 | B1 | * | 6/2002 | Messina | 361/715 |

FOREIGN PATENT DOCUMENTS

JP 58166750 A * 10/1983 ..... H01L/23/36

* cited by examiner

*Primary Examiner*—Boris Chervinsky

(57) ABSTRACT

Structure and methods are disclosed for transferring thermal energy from an object to a thermal spreader. A plurality of pins are biased against the object so that the plurality of pins contact with, and substantially conform to, a macroscopic surface of the object. Thermal energy is communicated from the object through the pins and through a plurality of air gaps between the pins and the thermal spreader. The pins are retained to the passageways of the thermal spreader so that the pins are retained with the thermal spreader when unbiased against the object.

28 Claims, 14 Drawing Sheets

PIN RETENTION FOR THERMAL TRANSFER INTERFACES, AND ASSOCIATED METHODS

RELATED APPLICATIONS

This application is a continuation-in-part of U.S. patent application Ser. No. 10/676,982, filed Oct. 1, 2003, which is a divisional application of U.S. Ser. No. 10/074,642, filed Feb. 12, 2002, each of which is incorporated herein by reference.

BACKGROUND OF THE INVENTION

Electronic systems often incorporate a semiconductor package (e.g., including a semiconductor die) that generates significant thermal energy. System designers spend considerable effort to provide sufficient heat dissipation capability in such systems by providing a thermally conductive path from the semiconductor package to a heat sink. The heat sink may for example be a ventilated conductive plate or an active device such as a thermoelectric cooler.

Certain difficulties arise when these electronic systems utilize multiple dies and other heat-generating devices. More particularly, each die and device must have its own heat dissipation capability; this for example complicates system design by requiring adequate ventilation and/or thermally conductive paths and heat sinks for the entire system. Such ventilation, thermal paths and heat sinks increase cost and complexity, among other negative factors.

Certain difficulties also arise in multiple die electronic systems because of mechanical tolerance build-up. That is, the physical mounting of multiple dies on a printed circuit board (PCB), for example, results in certain minute misalignment between reference surfaces intended to be co-aligned. Accordingly, any attempt to use a common heat sink must also accommodate the tolerance build-up to ensure appropriate thermal transfer across the physical interface. Tolerance build-up may for example occur due to the soldering that couples the dies to the PCB, and/or due to manufacturing inconsistencies in the rigid covers or "lids" which sometimes cover individual dies. In any event, a thermal sink coupled to multiple dies should account for these tolerance issues at the interface between the sink and the multiple dies in order to properly dissipate generated thermal energy. Designers of the prior art thus often overcompensate the thermal design to accommodate worst-case interface tolerance issues. Once again, this increases cost and complexity in the overall electronic system, among other negative factors.

SUMMARY OF THE INVENTION

In one embodiment, a thermal transfer interface is provided. A thermal spreader forms a plurality of passageways and a mating lip within each of the passageways. A spring element couples with the spreader. A plurality of thermally conductive pins are disposed with the passageways. Each of the pins has a head, shaft and barbed shaft end moving with the spring element. At least part of the shaft of internal to the passageway and forms a gap with an internal surface of the passageway, such that the pin heads collectively and macroscopically conform to an object coupled thereto to transfer heat from the object to the spreader through the passageway gap formed between the spreader and each of the plurality of pins. The barbed shaft end of each of the pins engages with the mating lip to retain the pins with the thermal spreader when the spring element is in an uncompressed state.

In one embodiment, A thermal transfer interface is provided. A thermal spreader forms a plurality of passageways and a retaining tab at the end of each of the passageways. A spring element couples with the spreader. A plurality of thermally conductive pins are disposed with the passageways. Each of the pins has a head and shaft moving with the spring element. At least part of the shaft is internal to the passageway and forms a gap with an internal surface of the passageway, such that the pin heads collectively and macroscopically conform to an object coupled thereto to transfer heat from the object to the spreader through the passageway gap formed between the spreader and each of the plurality of pins. Each shaft forms a shoulder that engages with the retaining tab to retain the pins with the thermal spreader when the spring element is in an uncompressed state.

In one embodiment, A thermal transfer interface is provided. A thermal spreader forms a plurality of passageways. A retaining plate couples to the thermal spreader and has one or more retaining tabs forming one or more apertures. A spring element couples with the spreader. A plurality of thermally conductive pins are disposed with the passageways. Each of the pins has a head and shaft moving with the spring element. At least part of the shaft is internal to the passageway and forms a gap with an internal surface of the passageway, such that the pin heads collectively and macroscopically conform to an object coupled thereto to transfer heat from the object to the spreader through the passageway gap formed between the spreader and each of the plurality of pins. Each shaft forms a shoulder that engages with one of the retaining tabs to retain the pins with the thermal spreader when the spring element is in an uncompressed state.

In one embodiment, a method transfers thermal energy from an object to a thermal spreader, including the steps of: biasing a plurality of pins against a surface of the object so that the plurality of pins contact with, and substantially conform to, a macroscopic surface of the object; communicating thermal energy from the object through the pins and a plurality of air gaps of the thermal spreader; and retaining the pins to passageways of the thermal spreader so that the pins are retained with the thermal spreader when unbiased against the object.

DETAILED DESCRIPTION OF THE DRAWINGS

Figure 1:
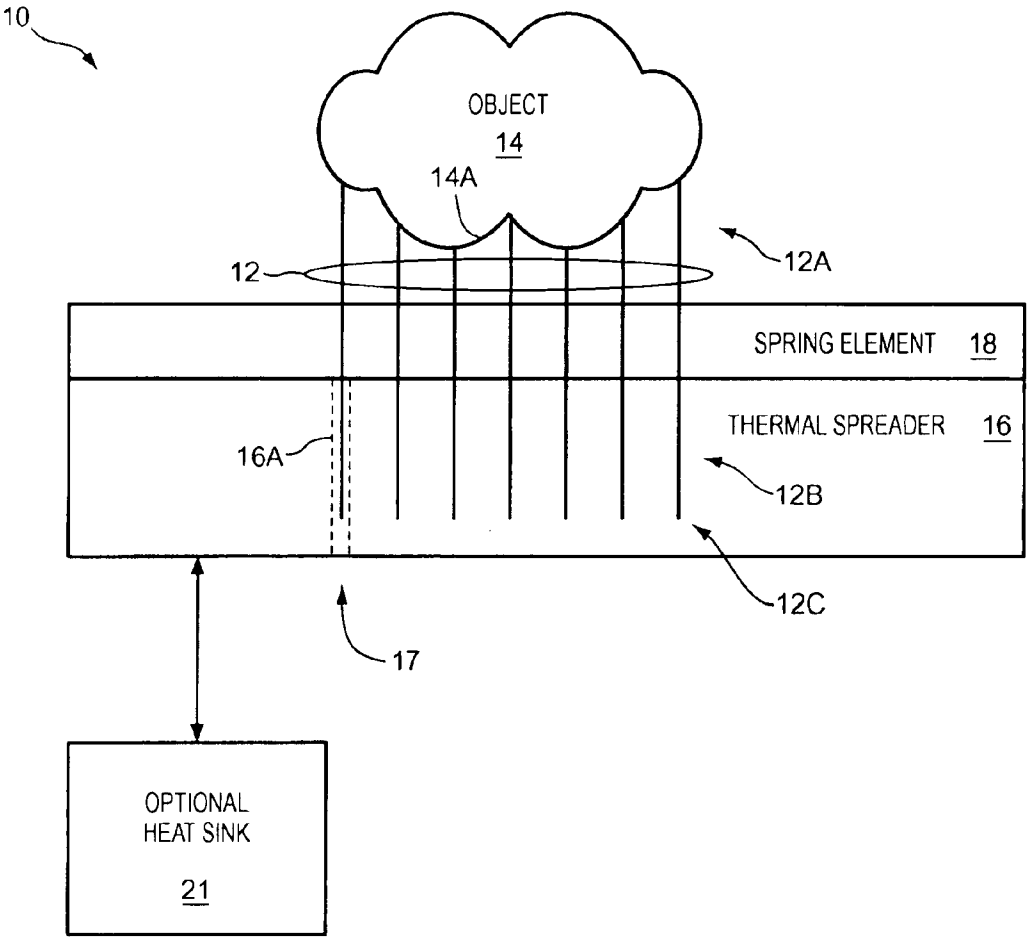
FIG. 1 shows a cross-sectional side view of one thermal transfer interface.

FIG. 1 shows a cross-sectional side view of one thermal transfer interface 10. Thermal transfer interface 10 includes a plurality of thermally conductive pins 12 that interface with an object 14, to transfer heat from object 14 to a thermal spreader 16. A spring element 18 facilitates coupling between pins 12 and object 14 such that pins 12 collectively conform with a surface 14A of object 14, even if surface 14A is non-planar, such as shown. As used hereinbelow, each pin 12 is described with a pin head 12A, pin shaft 12B, and shaft end 12C.

By way of operation, for those pins 12 that are in range of object 14, pin heads 12A are adjacent to, or in contact with object 14, while shafts 12B of pins 12 have at least some portion adjacent to, or in contact with thermal spreader 16. Pin shafts 12B pass within a like plurality of passageways 16A of spreader 16. For purposes of illustration, only one passageway 16A is shown and identified in FIG. 1; pin shafts 12B slide within passageways 16A to accommodate movement of pins 12, and/or spring element 18, in conformal contact with object 14. However, as described in various embodiments below, each pin 12 is retained such that pin 12 cannot slide completely out of its respective passageway 16A. Each passageway 16A may also be vented as a matter of design choice, for example to include an opening 17.

Figure 2:
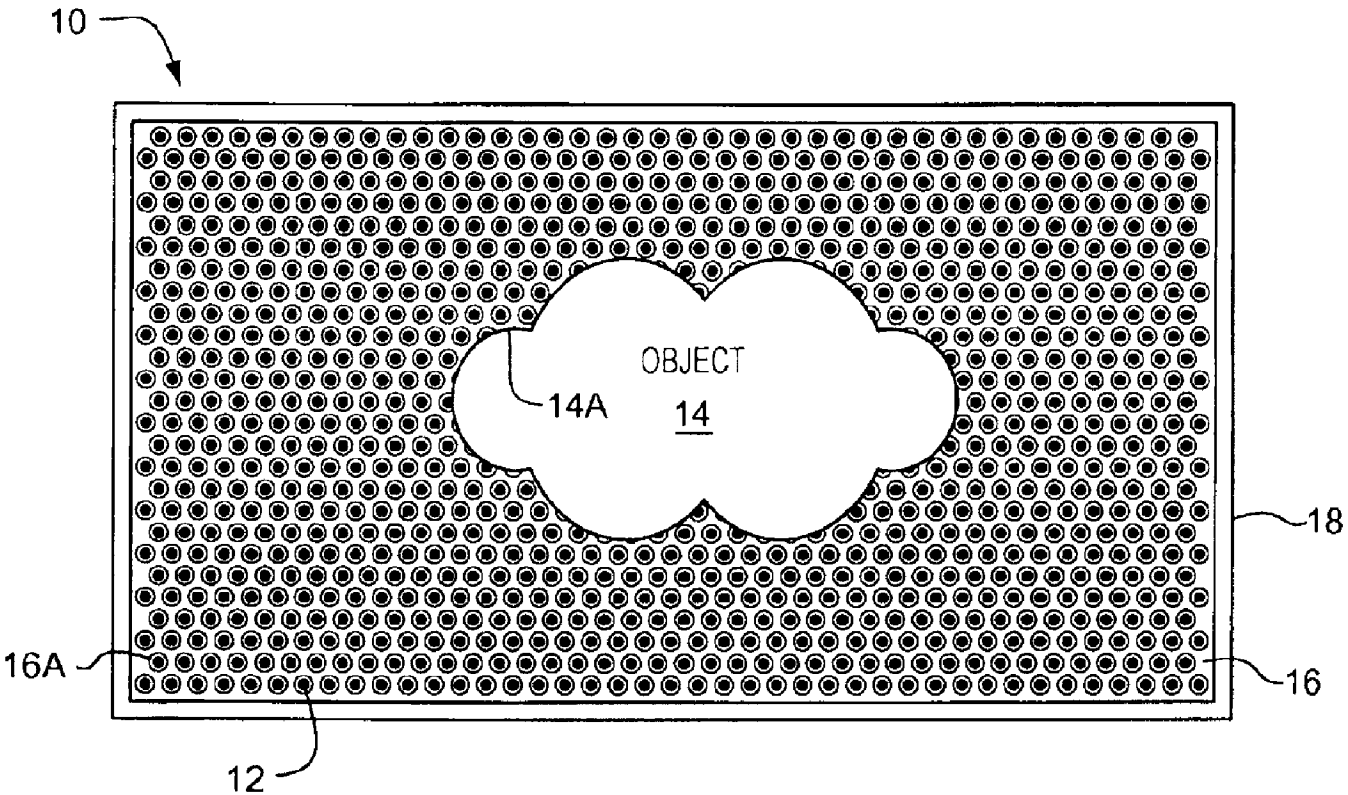
FIG. 2 shows a top view of the thermal transfer interface of FIG. 1.

FIG. 2 shows a top view of object 14 and thermal transfer interface 10. For purposes of illustration, spring element 18 is transparently shown so as to clearly show the plurality of passageways 16A with pins 12. In operation, thermal transfer interface 10 serves to dissipate heat from object 14 to spreader 16. Pins 12 are in thermal communication with object 14 when pins 12 (a) directly contact object 14, (b) couple to object 14 through a thermally conductive medium (e.g., thermal grease or a thermally conductive spring element 18), and/or (c) are close to object 14 such that the air gap between pin heads 12A and object 14 does not substantially prohibit heat transfer. It is not necessary that every pin 12 thermally communicate with object 14. Thermal transfer interface 10 utilizes a plurality of pins that number in the tens, hundreds, thousands or millions; collectively these pins macroscopically conform to surface 14A of object 14 to transfer heat from object 14, through a plurality of pins 12 and to thermal spreader 16.

Thermal spreader 16 may also form a heat sink to draw heat from object 14. An optional heat sink 21 may also couple to thermal spreader 16, as shown, to dissipate or assist in drawing heat from object 14. Heat sink 21 may for example be a ventilated (finned) conductive plate, liquid cold plate, evaporator, or an active device such as a thermoelectric cooler.

Figure 14:
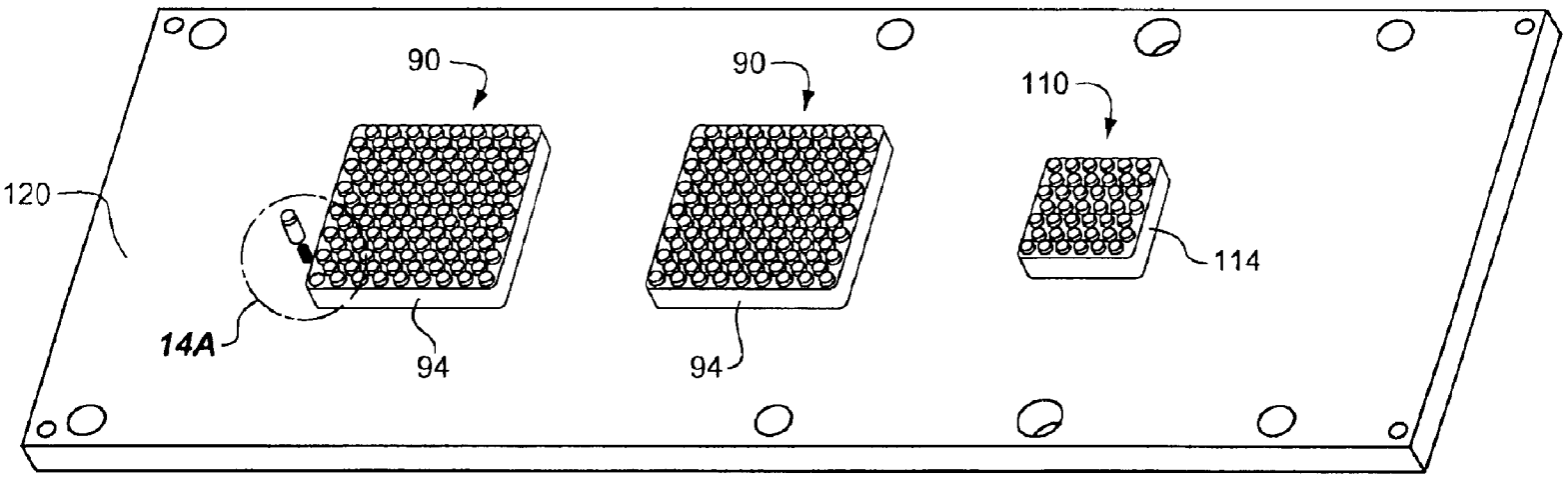
FIG. 14, FIG. 14A, FIG. 15 and FIG. 16 show the thermal transfer interfaces of FIG. 9 and FIG. 12 operationally connected to dissipate heat from semiconductor packages of a printed circuit board.
Figure 15:
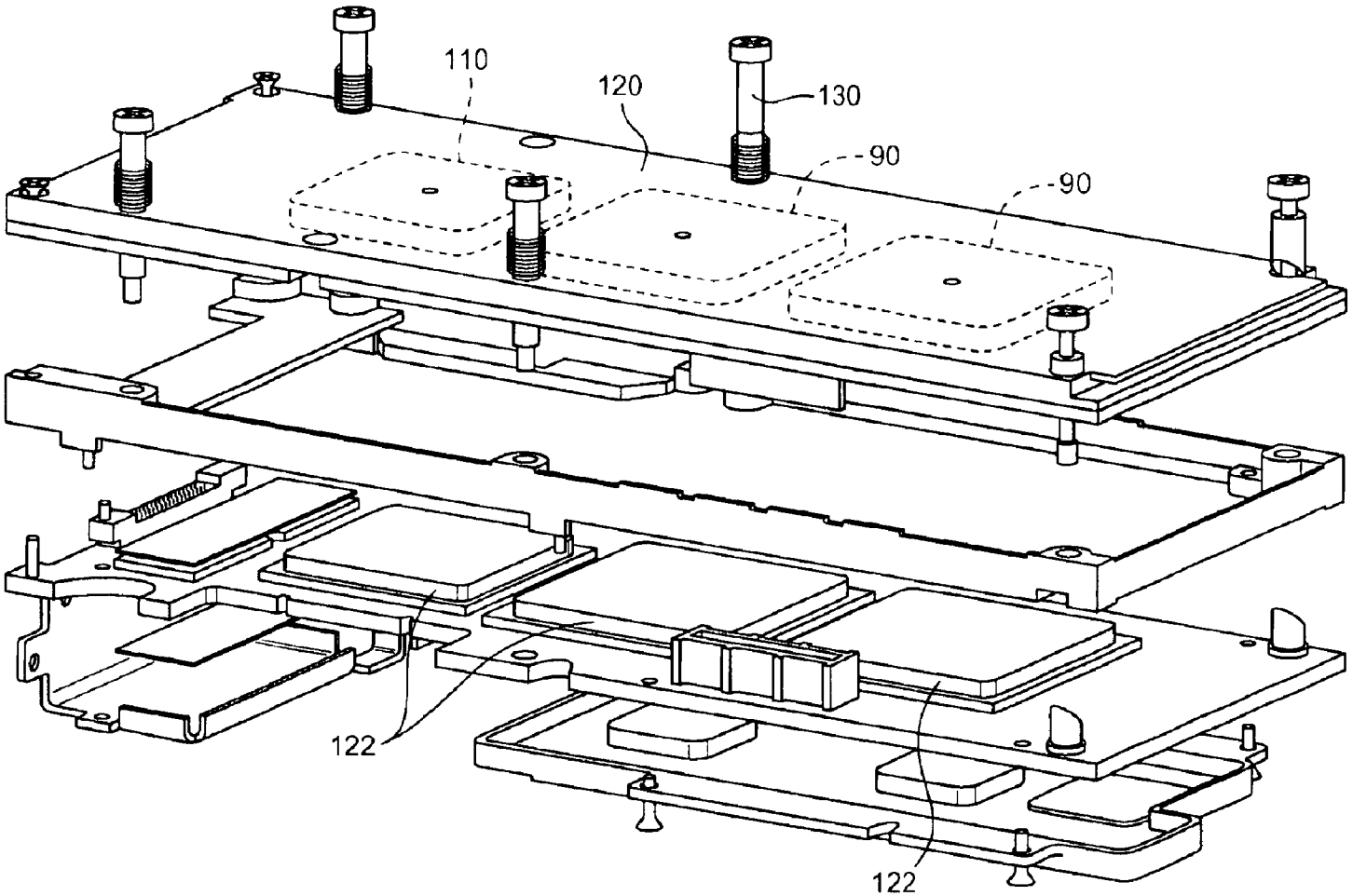
Figure 16:
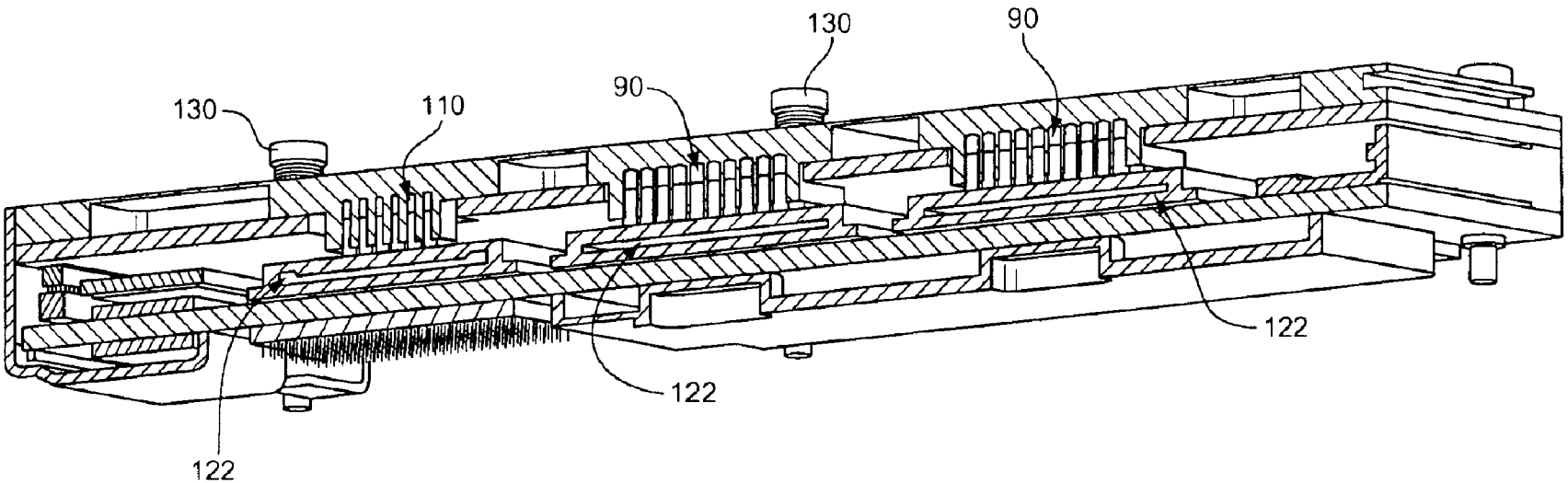

Object 14 may for example be a semiconductor die or package, such as shown in FIG. 14-FIG. 16. Spring element 18 may be replaced and/or augmented with different spring-like elements (e.g., rubberized material, helical spring coils), such as described in connection with FIG. 4A-FIG. 7B, FIG. 11, FIG. 14.

In one embodiment, each pin 12 has a cylindrical cross-sectional shape. Each passageway 16A of this embodiment, therefore, also has a corresponding cylindrical shape, to accommodate sliding of pin shaft 12B within its passageway 16A. Those skilled in the art appreciate that the cross-sectional shape of pins 12 and passageways 16A can take other forms, including rectangular or other shape as a matter of design choice.

In one embodiment, thermal spreader 16 and/or pins 12 are made from thermally conductive material, for example aluminum, copper, graphite or diamond.

As described in more detail below, it should be apparent that spring element 18 is shown illustratively, and that spring element 18 may be repositioned and take various forms without departing from the scope hereof. For example, in one embodiment spring element 18 is formed by a plurality of helical springs, each helical spring coaligned to each passageway 16A to bias its respective pin 12 towards object 14. In another embodiment, spring element 18 is a sponge-like layer, such as shown in FIG. 1, that biases all pin heads 12A toward object 14. In yet another embodiment, spring element 18 is formed from a plurality of sponge-like elements, each disposed within a passageway 16A to bias a respective one of pins 12 towards object 14.

Figure 3B:
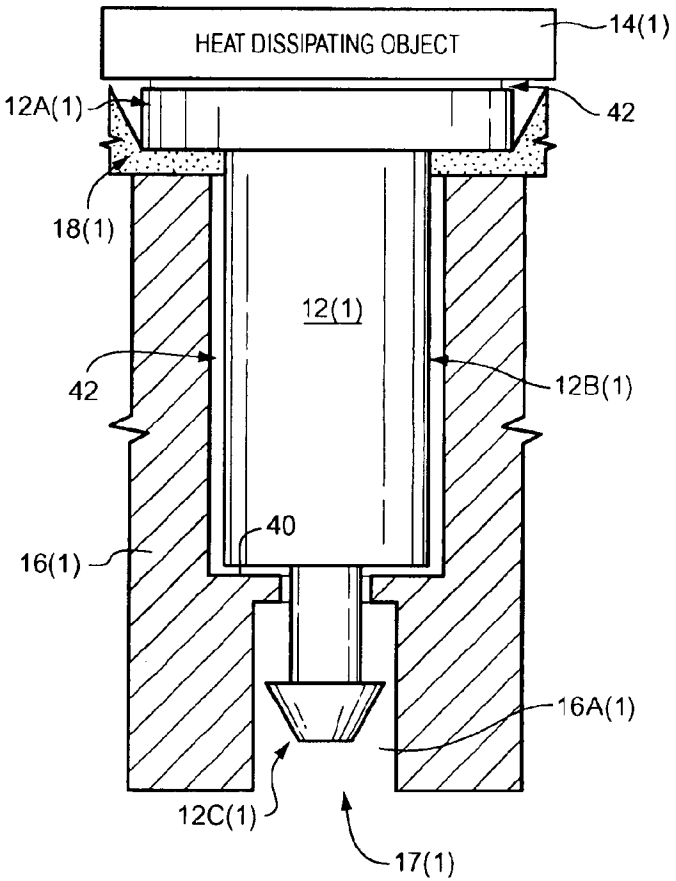
FIG. 3B shows the pin of FIG. 3A, with the spring element in a compressed state.
Figure 3A:
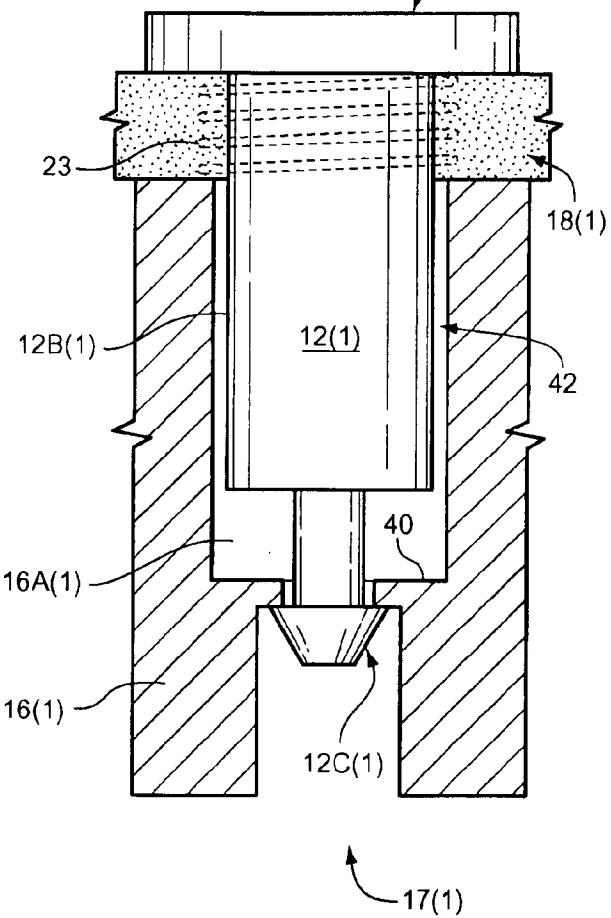
FIG. 3A shows a cross-sectional view of one pin and retaining mechanism, with a spring element in an uncompressed state.

Each pin 12, passageway 16A and spring element 18 may be configured as in FIG. 3A-3B, in accord with one embodiment. In FIG. 3A, specifically, a single pin 12(1) is shown extending through one passageway 16A(1) of thermal spreader 16(1), with spring element 18(1) in an uncompressed state. The uncompressed state occurs, for example, when pin 12(1) is not pressed against an object 14 (as in FIG. 3B). Pin 12(1) has a barbed shaft end 12C(1) that abuts against a mating lip 40 of thermal spreader 16(1) when spring element 18(1) is in the uncompressed state, thereby retaining pin 12(1) with passageway 16A(1) so that pin 12(1) does not completely slide out of passageway 16A(1). FIG. 3B shows pin 12(1) abutted against object 14(1) such that spring element 18(1) is in a compressed state. In FIG. 3B, barbed shaft end 12C(1) is disengaged from mating lip 40 because object 14(1) contacts pin head 12A(1), as shown, and thereby compresses spring element 18(1) to push barbed shaft end 12C(1) away from mating lip 40, towards opening 17(1) in thermal spreader 16(1). Opening 17(1) is optional and not required; it may be included as a matter of design choice.

Optionally, a thermally conductive grease 42 is disposed between pin shaft 12B(1) and thermal spreader 16(1), and/or between object 14(1) and pin head 12A(1), as shown. Other thermally conductive fluids or gasses may be used in place of grease 42 as a matter of design choice.

Spring element 18(1) is for example a thermally conductive sponge-like material (e.g., a silicon or rubber based material, metal foam). However, spring element 18(1) may comprise a plurality of helical springs disposed within each passageway 16, such as described in connection with FIG. 4A, FIG. 4B; it may alternatively comprise, for example, a helical spring for each pin 12 arranged between pin head 12A(1) and thermal spreader 16(1), such as shown by dotted outline 23 in FIG. 3A.

Figure 4B:
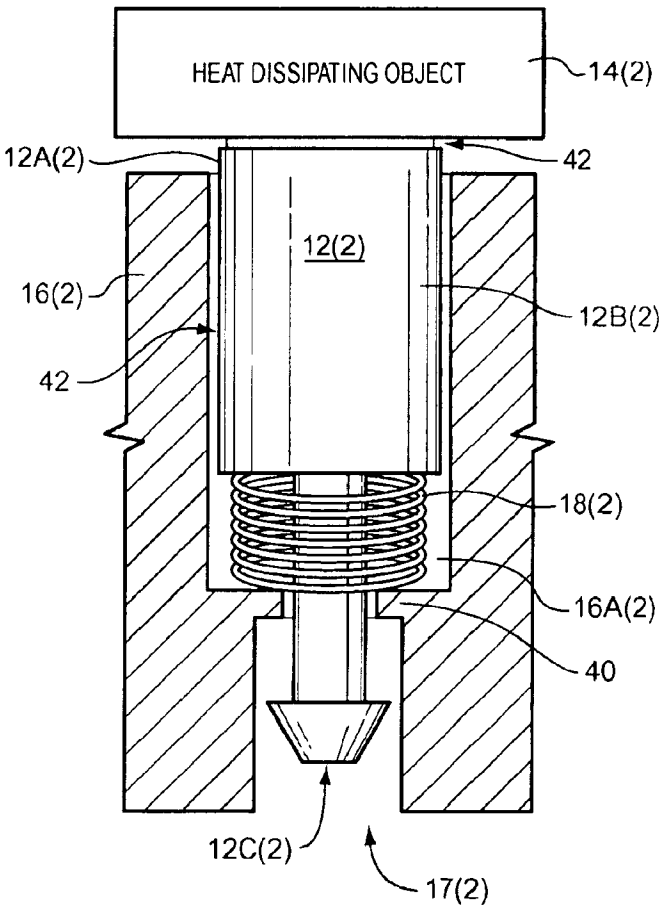
FIG. 4B shows the pin of FIG. 4A, with the spring element in a compressed state.
Figure 4A:
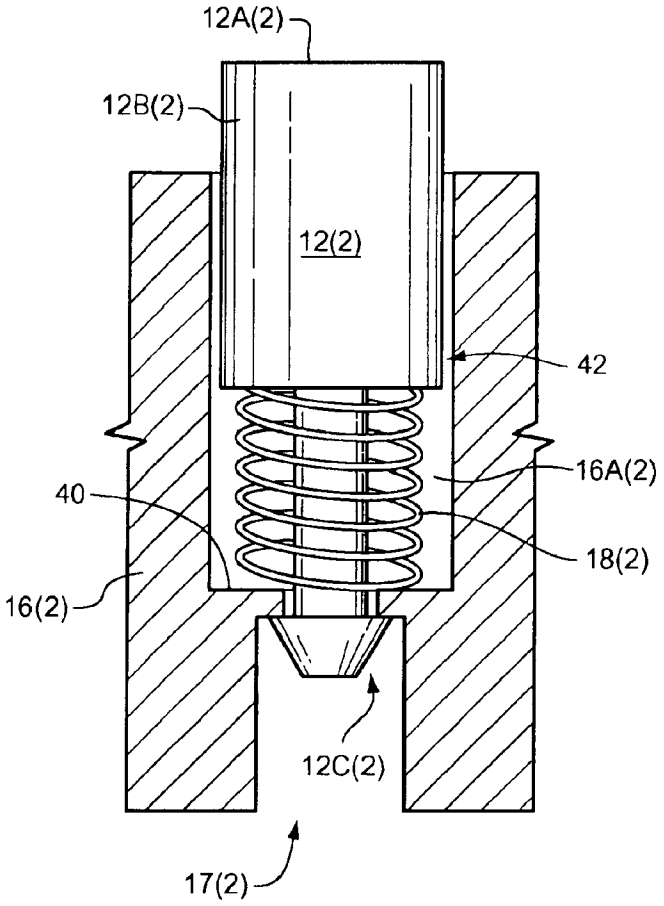
FIG. 4A shows a cross-sectional view of one pin and retaining mechanism, with a spring element in an uncompressed state.

Each pin 12, passageway 16A and spring element 18 of FIG. 1 may be configured as in FIG. 4A-4B, in accord with one embodiment. In FIG. 4A, specifically, a single pin 12(2) is shown extending through one passageway 16A(2) of thermal spreader 16(2), with spring element 18(2) in an uncompressed state. The uncompressed state occurs, for example, when pin 12(2) is not pressed against an object 14 (as in FIG. 4B). Pin 12(2) has a barbed shaft end 12C(2) that engages against mating lip 40 of thermal spreader 16(2) when spring element 18(2) is in the uncompressed state, thereby retaining pin 12(2) with passageway 16A(2) so that pin 12(2) does not completely slide out of passageway 16A(2). FIG. 4B shows pin 12(2) engaged against object 14(2) such that spring element 18(2) is in a compressed state. In FIG. 4B, barbed shaft end 12C(2) is disengaged from mating lip 40 because object 14(2) contacts pin head 12A(2), as shown, and thereby compresses spring element 18(2) to push barbed shaft end 12C(2) away from mating lip 40, towards opening 17(2) in thermal spreader 16(2). Opening 17(2) is optional and not required; it may be included as a matter of design choice.

Optionally, a thermally conductive grease 42 is disposed between pin shaft 12B(2) and thermal spreader 16(2), and/or between object 14(2) and pin head 12A(2), as shown. Other conductive fluids or gasses may be used in place of grease 42 as a matter of design choice.

In an alternative embodiment, spring element 18(2) is formed by a sponge-like material in place of the helical spring shown in FIGS. 4A, 4B.

Although mating lip 40 of FIG. 3A-3B, FIG. 4A-4B is shown as an extension of thermal spreader 16(1), 16(2) into passageway 16A(1), 16A(2), respectively, other retaining mechanisms may be employed. For example, FIG. 5A-5B, FIG. 6A-6B and FIG. 7A-7B show alternative embodiments for retaining pins with passageway 16A.

Figure 5B:
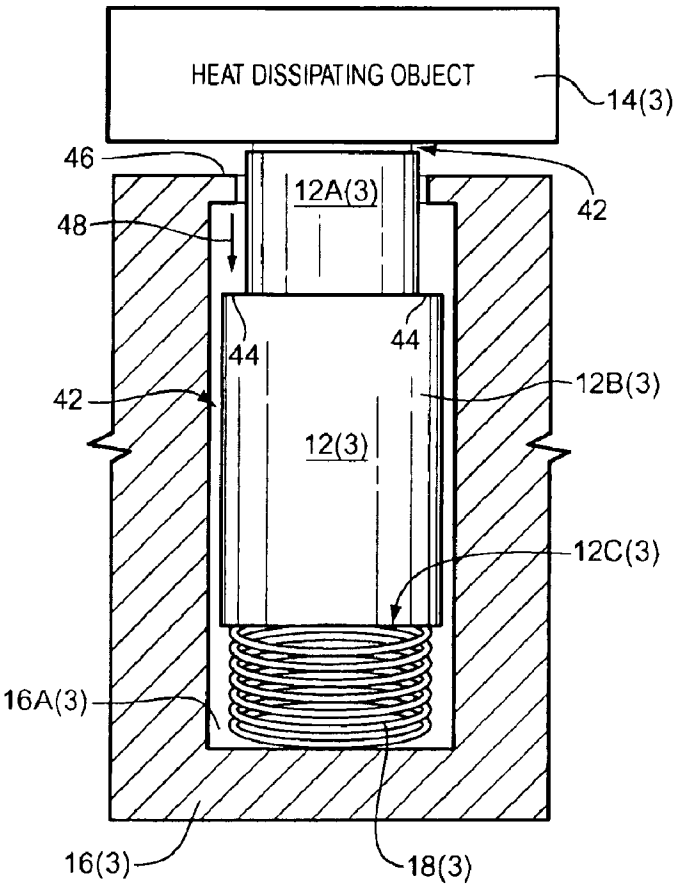
FIG. 5B shows the pin of FIG. 5A, with the spring element in a compressed state.
Figure 5A:
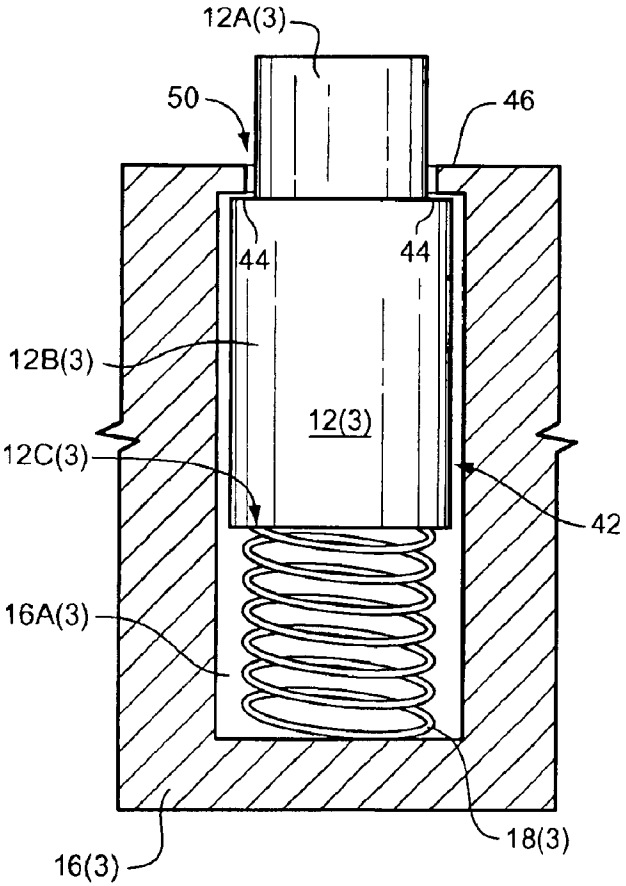
FIG. 5A shows a cross-sectional view of one pin and retaining mechanism, with a spring element in an uncompressed state.

More particularly, each pin 12, passageway 16A and spring element 18 of FIG. 1 may be configured as in FIG. 5A-5B, in accord with one embodiment. In FIG. 5A, specifically, a single pin 12(3) is shown extending through one passageway 16A(3) of thermal spreader 16(3), with spring element 18(3) in an uncompressed state. The uncompressed state occurs, for example, when pin 12(3) is not pressed against an object 14 (as in FIG. 5B). Pin 12(3) has a shoulder 44 formed between pin head 12A(3) and pin shaft 12B(3) that abuts against a retaining tab 46 of thermal spreader 16(3) when spring element 18(3) is in the uncompressed state, thereby retaining pin 12(3) with passageway 16A(3) so that pin 12(3) does not completely slide out of passageway 16A(3). FIG. 5B shows pin 12(3) engaged against object 14(3) such that spring element 18(3) is in a compressed state. In FIG. 5B, shoulder 44 is disengaged from retaining tab 46 because object 14(3) contacts pin head 12A(3), as shown, and thereby compresses spring element 18(3) to push pin shaft 12B(3) (and, hence, shoulder 44) away from retaining tab 46 (i.e., along direction 48).

Unlike FIGS. 3A, 3B, 4A, 4B, there is no opening 17 within spreader 16(3) (FIGS. 6A, 6B below illustrate a similar configuration with an opening 17(4)). Accordingly, in this embodiment, venting of passageway 16A(3) occurs through opening 50 of passageway 16A(3) as formed by retaining tabs 46. Thermally conductive grease 42 may be disposed between pin shaft 12B(3) and thermal spreader 16(3), and/or between object 14(3) and pin head 12A(3), as shown. In an alternative embodiment, spring element 18(3) is formed by a sponge-like material in place of the helical spring shown in FIGS. 5A, 5B.

Figure 6B:
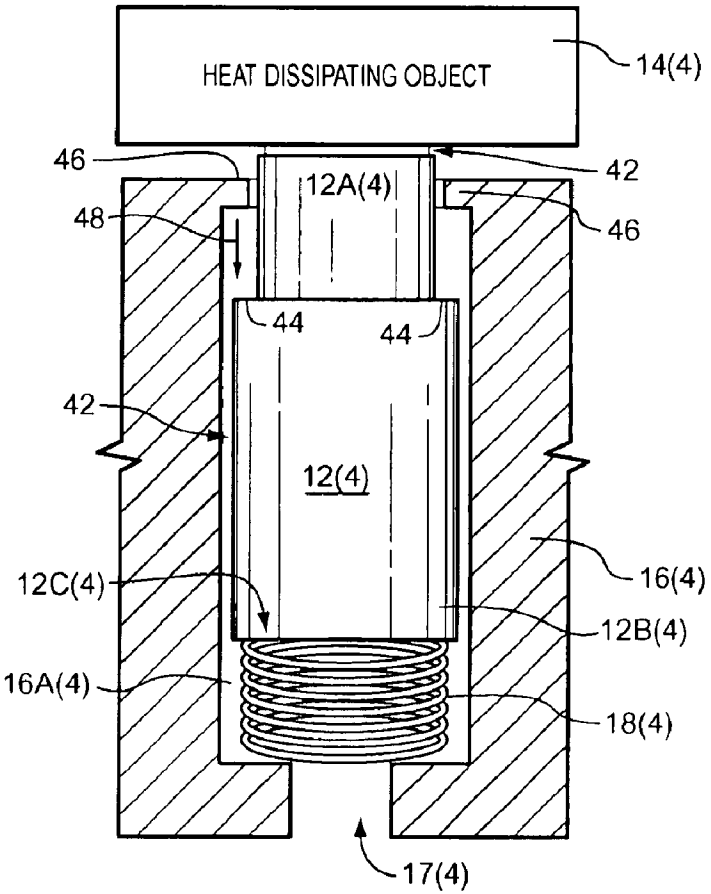
FIG. 6B shows the pin of FIG. 6A, with the spring element in a compressed state.
Figure 6A:
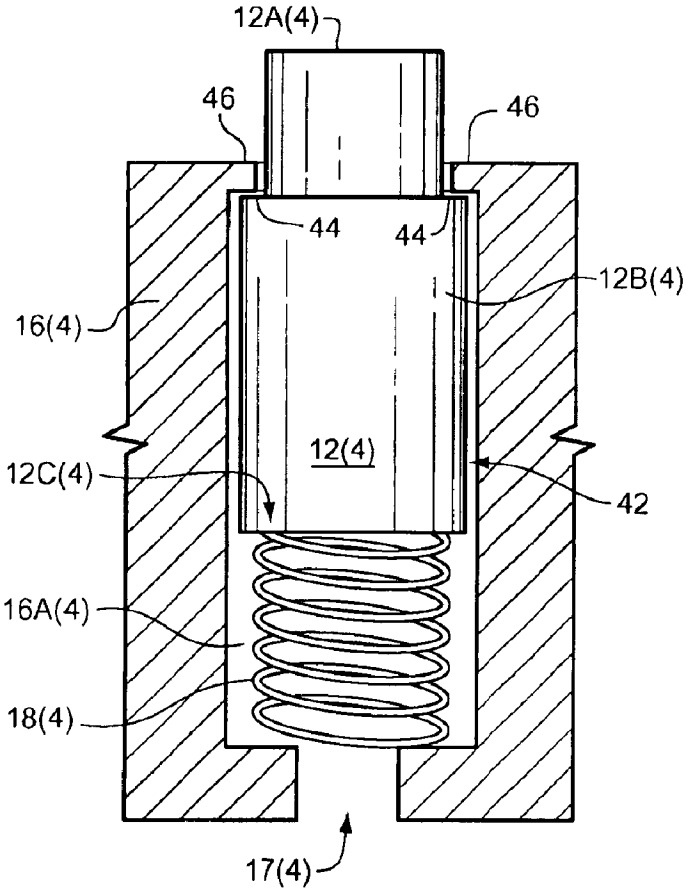
FIG. 6A shows a cross-sectional view of one pin and retaining mechanism, with a spring element in an uncompressed state.

Each pin 12, passageway 16A and spring element 18 of FIG. 1 may be configured as in FIG. 6A-6B, in accord with one embodiment. In FIG. 6A, specifically, a single pin 12(4) is shown extending through one passageway 16A(4) of thermal spreader 16(4), with spring element 18(4) in an uncompressed state. The uncompressed state occurs, for example, when pin 12(4) is not pressed against an object 14 (as in FIG. 6B). Pin 12(4) has a shoulder 44 formed between pin head 12A(4) and pin shaft 12B(4) that abuts against retaining tab 46 of thermal spreader 16(4) when spring element 18(4) is in the uncompressed state, thereby retaining pin 12(4) with passageway 16A(4) so that pin 12(4) does not completely slide out of passageway 16A(4). FIG. 6B shows pin 12(4) engaged against object 14(4) such that spring element 18(4) is in a compressed state. In FIG. 6B, shoulder 44 is disengaged from retaining tab 46 because object 14(4) contacts pin head 12A(4), as shown, and thereby compresses spring element 18(4) to push pin shaft 12B(4) (and hence shoulder 44) away from retaining tab 46 (i.e., along direction 48).

Unlike 5A, 5B, a vent is formed through spreader 16(4) and into passageway 16A(4), via opening 17(4). Once again, thermally conductive grease 42 may be disposed between pin shaft 12B(4) and thermal spreader 16(4), and/or between object 14(4) and pin head 12A(4), as shown. Other conductive fluids or gasses may be used in place of grease 42 as a matter of design choice. In an alternative embodiment, spring element 18(4) is formed by a sponge-like material in place of the helical spring shown in FIGS. 6A, 6B.

Figure 7B:
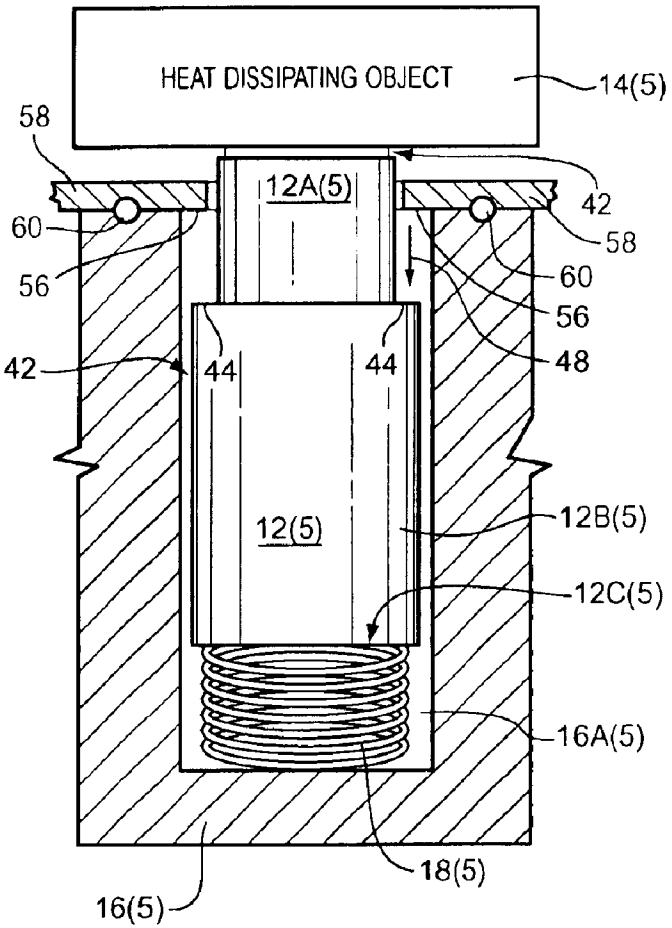
FIG. 7B shows the pin of FIG. 7A, with the spring element in a compressed state.
Figure 7A:
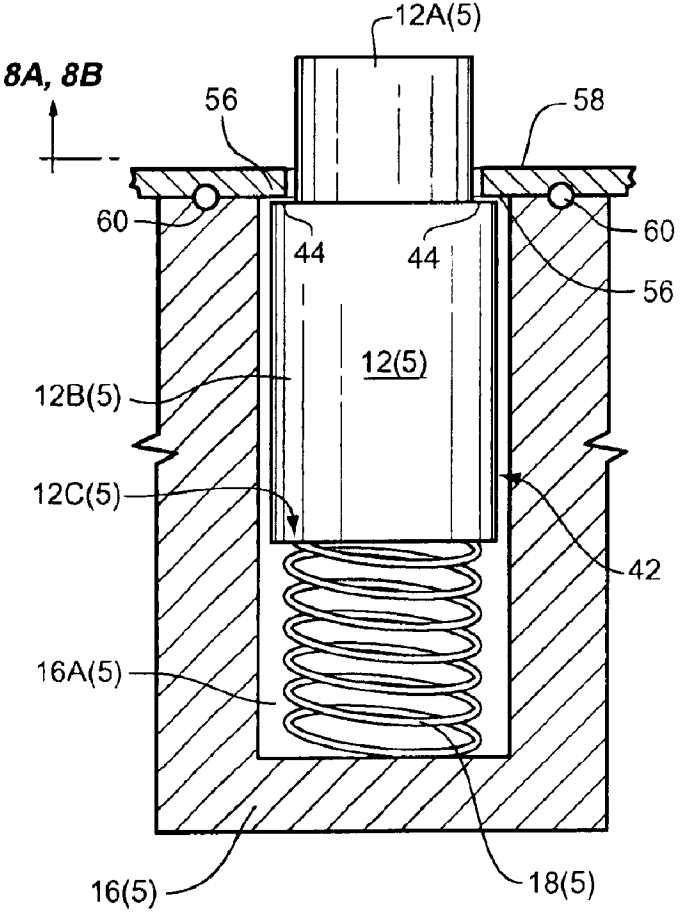
FIG. 7A shows a cross-sectional view of one pin and retaining mechanism, with a spring element in an uncompressed state.

Each pin 12, passageway 16A and spring element 18 of FIG. 1 may be configured as in FIG. 7A-7B, in accord with one embodiment. In FIG. 7A, specifically, a single pin 12(5) is shown extending through one passageway 16A(5) of thermal spreader 16(5), with spring element 18(5) in an uncompressed state. The uncompressed state occurs, for example, when pin 12(5) is not pressed against an object 14 (as in FIG. 7B). Pin 12(5) has a shoulder 44 formed between pin head 12A(5) and pin shaft 12B(5) that abuts against a retaining tab 56 of a retaining plate 58 when spring element 18(5) is in the uncompressed state, thereby retaining pin 12(5) with passageway 16A(5) so that pin 12(5) does not completely slide out of passageway 16A(5). FIG. 7B shows pin 12(5) engaged against object 14(5) such that spring element 18(5) is in a compressed state. In FIG. 7B, shoulder 44 is disengaged from retaining tab 56 because object 14(5) contacts pin head 12A(5), as shown, and thereby compresses spring element 18(5) to push pin shaft 12B(5) (and hence shoulder 44) away from retaining tab 56 (i.e., along direction 48).

Although not shown, a vent 17 may be formed into spreader 16(5), as in FIGS. 4A, 4B. Additionally, thermally conductive grease 42 may be disposed between pin shaft 12B(5) and thermal spreader 16(5), and/or between object 14(5) and pin head 12A(5), as shown. Other conductive fluids or gasses may be used in place of grease 42 as a matter of design choice. In an alternative embodiment, spring element 18(5) is formed by a sponge-like material in place of the helical spring shown in FIGS. 7A, 7B.

Figure 8B:
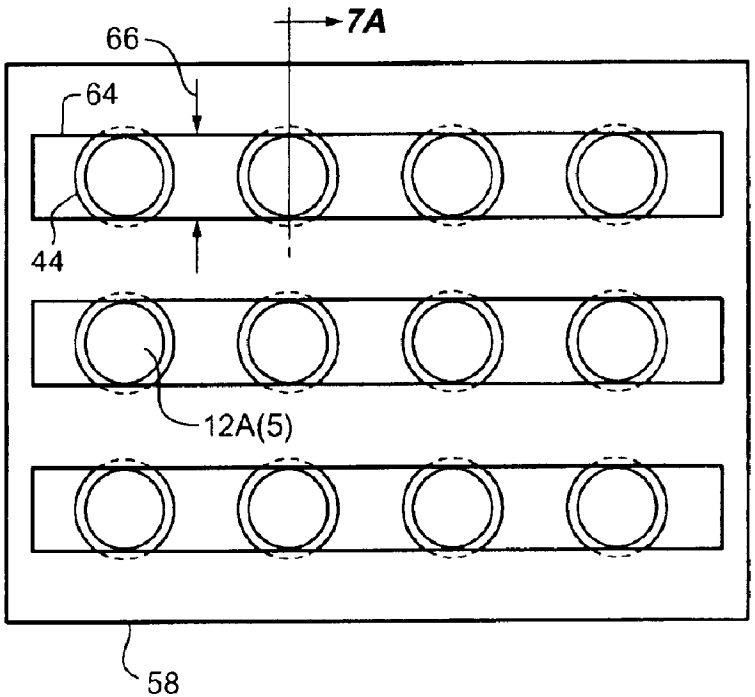
FIG. 8B shows one retaining plate with a plurality of apertures, one for a plurality of pin passageways of a thermal spreader.
Figure 8A:
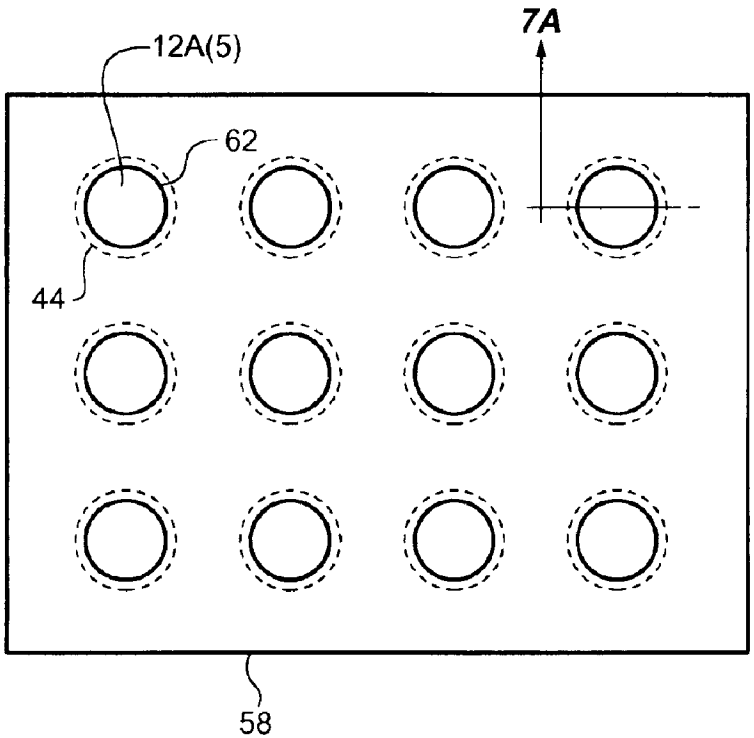
FIG. 8A shows one retaining plate with a plurality of apertures, one for each pin passageway of a thermal spreader.

Retaining plate 58 may attach to thermal spreader 16(5) by any of several techniques, for example by screws, glue, clamps, springs and/or rivets—any and all of which are illustratively shown by attachment element 60. In one embodiment, shown in FIG. 8A, the retaining tabs 56 of retaining plate 58 form a plurality of apertures 62, each one retaining a respective pin 12(5) to its respective passageway 16A(5). However, in another embodiment shown in FIG. 8B, the retaining tabs 56 of retaining plate 58 may alternatively form fewer apertures 64, each to retain a plurality of pins 12(5). More particularly, in FIG. 8A, shoulder 44 of each pin 12(5) is shown in dotted outline relative to each opening 62, illustrating that the diameter of shoulder 44 is larger than aperture 62 so as to retain pin shaft 12B(5) with passageway 16A(5). In FIG. 8B, shoulder 44 is also shown in dotted outline relative to aperture 64, illustrating that a dimension 66 of aperture 64 is smaller than the diameter of shoulder 44 so as to retain pin shaft 12B(5) with passageway 16A(5). In the illustrated example of FIG. 8B, aperture 64 of retaining plate 58 serves to retain four pins 12(5) to four passageways 16A(5). Other aperture configurations may be formed within retaining plate 58 as a matter of design choice. In FIG. 8A, because the diameter of pin head 12A(5) is substantially the same size as aperture 62 (but slightly smaller to pass through aperture 62), the outer dimension of pin head 12A(5) is not shown. In FIG. 8B, however, pin head 12A(5) is shown within aperture 64; its diameter is slightly less than dimension 66 to accommodate passage of pin head 12A(5) through aperture 66.

Figure 9:
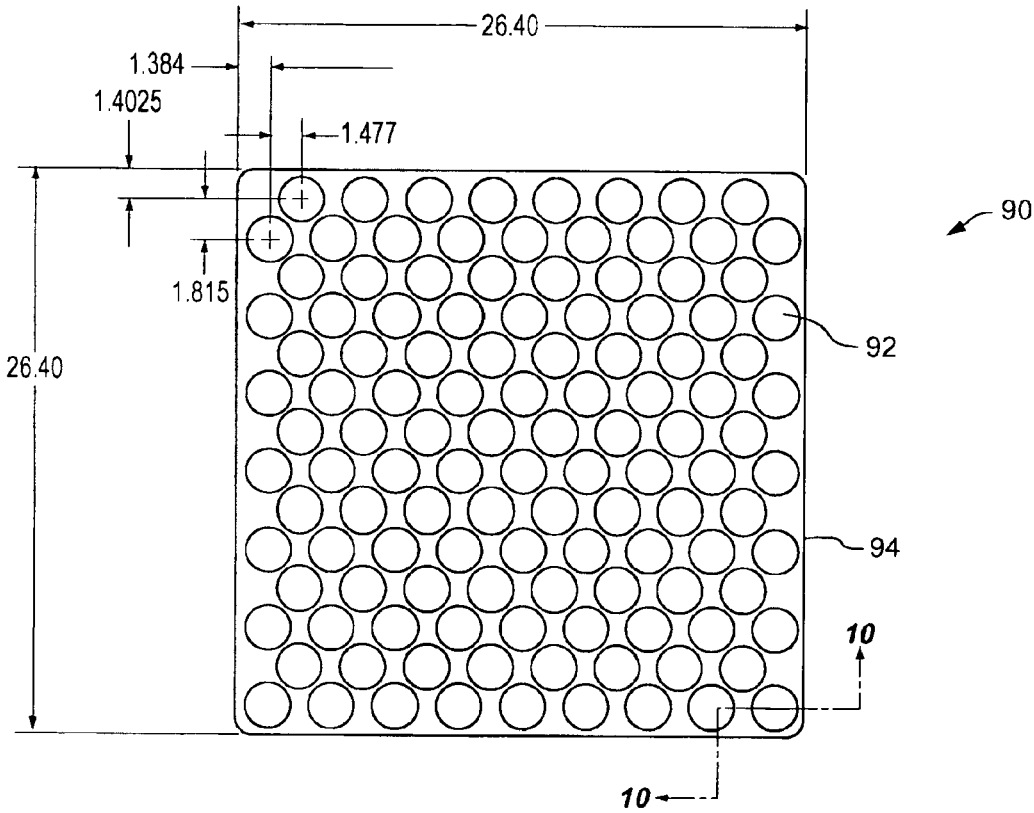
FIG. 9 shows a top view of one thermal transfer interface.
Figure 10:
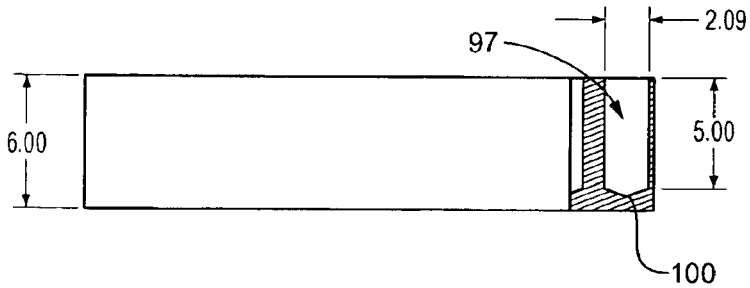
FIG. 10 shows a cross-sectional view part of the thermal transfer interface of FIG. 9.
Figure 11:
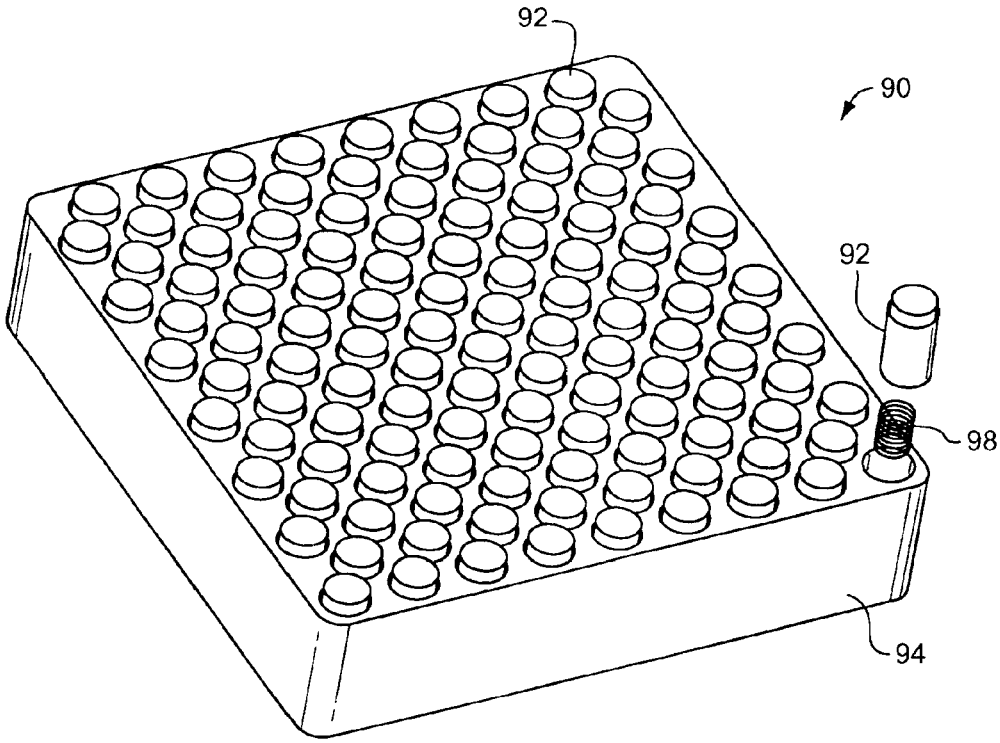
FIG. 11 shows a perspective view of the thermal transfer interface of FIG. 9.

FIG. 9 shows a top view of one thermal transfer interface 90; FIG. 10 shows a cross-sectional view of part of thermal transfer interface 90; and FIG. 11 shows a perspective view of thermal transfer interface 90. A plurality of pins 92 conform to a surface of an object (e.g., object 14, FIG. 1) so as to dissipate heat from the object to a thermal spreader 94. Each of pins 92 has a shaft within respective passageways 97 of thermal spreader 94; sizing of pins 92 within passageways 97 forms a small gap between each pin 92 and spreader 94. The gap may be filled with thermally conductive material such as grease, such as described above. Exemplary dimensions for thermal transfer interface 90 are also illustrated in FIG. 9-FIG. 11. A helical spring element 98 is shown in FIG. 11; spring element 98 for example operates like spring elements 18, 18(1)–18(5) of FIG. 1-FIG. 7B. FIG. 10 and FIG. 11 also illustrate an optional drill point 100 which may be used to form a vent 17, as a matter of design choice.

Figure 12:
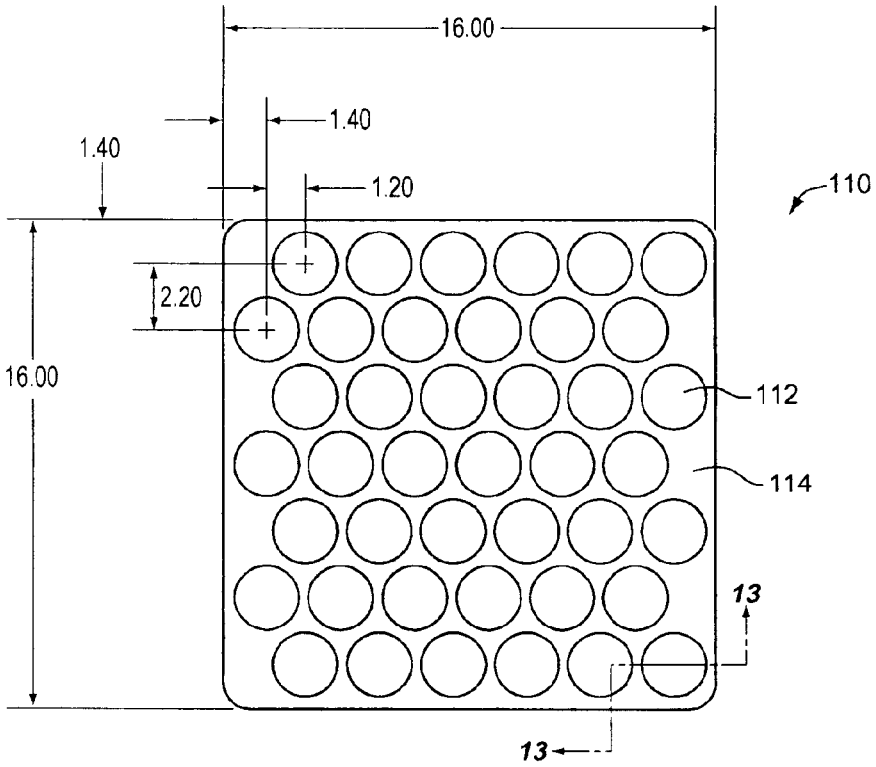
FIG. 12 shows a top view of one thermal transfer interface.
Figure 13:
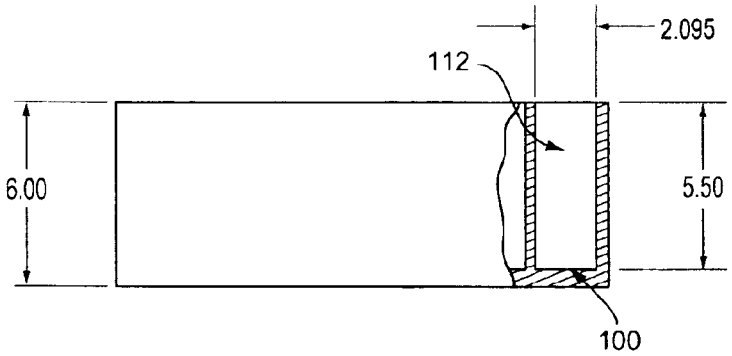
FIG. 13 shows a cross-sectional view of part of the thermal transfer interface of FIG. 12.

FIG. 12 shows a top view of one thermal transfer interface 110, and FIG. 13 shows a cross-sectional view of part of thermal transfer interface 110, to illustrate other exemplary dimensions suitable for use with an operational thermal transfer interface 10, FIG. 1. In FIG. 11, a plurality of pins (not shown) are disposed with a like plurality of passageways 112 to conform to a surface of an object (e.g., object 14, FIG. 1) so as to dissipate heat from the object to a thermal spreader 114.

Figure 14A:
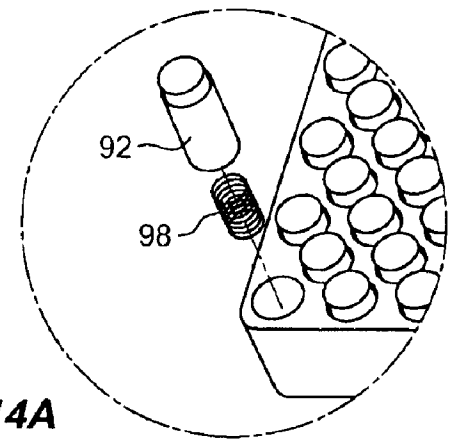

FIG. 14, FIG. 14A, FIG. 15 and FIG. 16 illustrate how multiple thermal transfer interfaces 90, 110 may for example dissipate heat from multiple objects in the form of semiconductor packages 122. As shown in FIG. 14, two thermal transfer interfaces 90 and one thermal transfer interface 110 are available to couple to packages 122, to dissipate heat generated thereby to a thermal sink 120. Each package 122 may include a die that is typically smaller in surface area than its corresponding thermal transfer interface 90, 110. That is, each package 122 may be larger than its corresponding thermal transfer interface as a matter of design choice; generally, however, each thermal transfer interface 90, 110 at least covers the surface area of the die within package 122 (thermal transfer interface 110 is smaller than thermal transfer interface 90 so may operate to cool a smaller die within its corresponding package 122, in this example). FIG. 14A shows greater detail of pin 92 and helical spring 98 of FIG. 14. FIG. 15 also shows how compression springs and screws 130 may be used to force thermal transfer interfaces 90, 110 against packages 122, as shown in FIG. 16.

Changes may be made in the above methods, interfaces and apparatus without departing from the scope hereof. It should thus be noted that the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall there between.

What is claimed is:

1. A thermal transfer interface, comprising:

a thermal spreader forming a plurality of passageways and a mating lip within each of the passageways;

a spring element coupled with the spreader; and a plurality of thermally conductive pins for the passageways, each of the pins having a head, shaft and barbed shaft end moving with the spring element, at least part of the shaft being internal to the passageway and forming a gap with an internal surface of the passageway, wherein the pin heads collectively and macroscopically conform to an object coupled thereto to transfer heat from the object to the spreader through the passageway gap formed between the spreader and each of the plurality of pins, the barbed shaft end of each of the pins engaging with the mating lip to retain the pins with the thermal spreader when the spring element is in an uncompressed state.

2. The thermal transfer interface of claim 1, the spring element forming a layer with a substantially planar face, each of the pin heads either (a) protruding from the face in a direction away from the spreader, (b) being substantially flush with the face or (c) being recessed within the spring element.

3. The thermal transfer interface of claim 1, each of the pin shafts being cylindrical, each of the passageways being substantially perpendicular to a planar surface of the spring element and being cylindrical to accommodate motion of the shafts therethrough.

4. The thermal interface of claim 1, each of the pin shafts being rectangular, each of the passageways being substantially perpendicular to a planar surface of the spring element and being rectangular to accommodate motion of the shafts therethrough.

5. The thermal transfer interface of claim 1, the object comprising one or more semiconductor packages and dies.

6. The thermal transfer interface of claim 1, the spring element comprising a thermally conductive sponge-like material.

7. The thermal transfer interface of claim 6, the sponge-like material being positioned between the thermal spreader and the object.

8. The thermal transfer interface of claim 7, the sponge-like material positioned between the thermal spreader and the pin head.

9. The thermal transfer interface of claim 6, the sponge-like material being positioned within each of the passageways to bias the pins towards the object.

10. The thermal transfer interface of claim 1, the thermal spreader forming a vent opening to one or more of the passageways.

11. The thermal transfer interface of claim 1, the spring element comprising a plurality of helical springs disposed within the passageways, each of the helical springs disposed within a separate one of the passageways between the mating lip and shaft, for biasing the pins outwardly from the spreader towards the object.

12. The thermal transfer interface of claim 1, the spring element comprising a plurality of helical springs coaligned with the passageways, each of the helical springs arranged to bias a separate one of the pins outwardly from the spreader towards the object.

13. A thermal transfer interface, comprising:

a thermal spreader forming a plurality of passageways and a retaining tab at the end of each of the passageways;

a spring element coupled with the spreader; and a plurality of thermally conductive pins for the passageways, each of the pins having a head and shaft moving with the spring element, at least part of the shaft being internal to the passageway and forming a gap with an internal surface of the passageway, wherein the pin heads collectively and macroscopically conform to an object coupled thereto to transfer heat from the object to the spreader through the passageway gap formed between the spreader and each of the plurality of pins, each shaft forming a shoulder that engages with the retaining tab to retain the pins with the thermal spreader when the spring element is in an uncompressed state.

14. The thermal transfer interface of claim 13, each of the pin shafts being cylindrical, each of the passageways being substantially perpendicular to a planar surface of the spring element and being cylindrical to accommodate motion of the shafts therethrough.

15. The thermal interface of claim 14, each of the pin shafts being rectangular, each of the passageways being substantially perpendicular to a planar surface of the spring element and being rectangular to accommodate motion of the shafts therethrough.

16. The thermal transfer interface of claim 14, the object comprising one or more semiconductor packages and dies.

17. The thermal transfer interface of claim 14, the thermal spreader forming a vent opening to one or more of the passageways.

18. The thermal transfer interface of claim 14, the spring element comprising a plurality of helical springs, each of the helical springs disposed within a separate one of the passageways between the shaft and thermal spreader, for biasing the pins outwardly from the spreader toward the object.

19. The thermal transfer interface of claim 14, the spring element comprising a sponge-like material disposed within each of the passageways, to bias the pins outwardly from the spreader toward the object.

20. A thermal transfer interface, comprising:

a thermal spreader forming a plurality of passageways;

a retaining plate coupled to the thermal spreader and having one or more retaining tabs forming one or more apertures;

a spring element coupled with the spreader; and a plurality of thermally conductive pins for the passageways, each of the pins having a head and shaft moving with the spring element, at least part of the shaft being internal to the passageway and forming a gap with an internal surface of the passageway, wherein the pin heads collectively and macroscopically conform to an object coupled thereto to transfer heat from the object to the spreader through the passageway gap formed between the spreader and each of the plurality of pins, each shaft forming a shoulder that engages with one of the retaining tabs to retain the pins with the thermal spreader when the spring element is in an uncompressed state.

21. The thermal transfer interface of claim 20, each of the pin shafts being cylindrical, each of the passageways being substantially perpendicular to a planar surface of the spring element and being cylindrical to accommodate motion of the shafts therethrough.

22. The thermal interface of claim 20, each of the pin shafts being rectangular, each of the passageways being substantially perpendicular to a planar surface of the spring element and being rectangular to accommodate motion of the shafts therethrough.

23. The thermal transfer interface of claim 20, the object comprising one or more semiconductor packages and dies.

24. The thermal transfer interface of claim 20, the thermal spreader forming a vent opening to one or more of the passageways.

25. The thermal transfer interface of claim 20, the spring element comprising a plurality of springs, each of the springs disposed within a separate one of the passageways to bias the pin head outwardly from the spreader towards the object.

26. The thermal transfer interface of claim 20, the spring element comprising a sponge-like material disposed within each of the passageways to bias the pins outwardly from the spreader towards the object.

27. The thermal transfer interface of claim 20, each of the apertures corresponding to one of the passageways, wherein one of the retaining tabs retains a corresponding one of the pins within the one passageway.

28. The thermal transfer interface of claim 20, each of the apertures corresponding to two or more passageways, wherein one of the retaining tabs retains two or more pins within the two or more passageways.

* * * * *